US007003989B2

(12) United States Patent
St. James

(10) Patent No.: US 7,003,989 B2
(45) Date of Patent: Feb. 28, 2006

(54) LOCK PROTECTOR

(76) Inventor: Thomas Michael St. James, 4128 N. Clarendon, Chgo, IL (US) 60613

( * ) Notice: Subject to any disclaimer, the term of this patent is extended or adjusted under 35 U.S.C. 154(b) by 0 days.

(21) Appl. No.: 10/797,433

(22) Filed: Mar. 10, 2004

(65) Prior Publication Data

US 2005/0199020 A1 Sep. 15, 2005

(51) Int. Cl.
*E05B 67/38* (2006.01)

(52) U.S. Cl. ..... 70/56; 70/54; D8/335

(58) Field of Classification Search ..... 70/54–56, 70/53; D3/346, 335; 292/281
See application file for complete search history.

(56) References Cited

U.S. PATENT DOCUMENTS

| | | | | | |
|---|---|---|---|---|---|
| 3,783,657 | A | | 1/1974 | Foote | |
| 3,828,591 | A | * | 8/1974 | Beaver | 70/56 |
| 4,106,315 | A | * | 8/1978 | Dohanyos | 70/56 |
| 4,238,941 | A | * | 12/1980 | Halopoff | 70/56 |
| 4,300,370 | A | * | 11/1981 | Kaiser et al. | 70/54 |
| 4,744,229 | A | | 5/1988 | Stanich | |
| 4,745,783 | A | * | 5/1988 | Poe | 70/2 |
| 4,799,369 | A | | 1/1989 | Goodson et al. | |
| 4,843,845 | A | * | 7/1989 | Poe | 70/54 |
| 4,877,275 | A | * | 10/1989 | DeForrest, Sr. | 292/148 |
| 4,882,918 | A | * | 11/1989 | Stanich | 70/54 |
| D317,248 | S | * | 6/1991 | Poe | D8/346 |
| 5,118,149 | A | * | 6/1992 | Emmons | 292/327 |
| D330,843 | S | * | 11/1992 | Anderson | D8/335 |
| 5,219,384 | A | * | 6/1993 | Elsfelder et al. | 70/18 |
| 5,303,568 | A | | 4/1994 | Wightman | |
| 5,477,710 | A | * | 12/1995 | Stefanutti | 70/56 |
| D375,448 | S | * | 11/1996 | Small et al. | D8/346 |
| D378,568 | S | * | 3/1997 | Small et al. | D8/346 |
| D409,075 | S | * | 5/1999 | Berger | D8/335 |
| 6,009,731 | A | * | 1/2000 | Emmons et al. | 70/56 |
| 6,010,166 | A | * | 1/2000 | Hamilton et al. | 292/282 |
| D430,998 | S | * | 9/2000 | Chelaru | D8/335 |
| D431,446 | S | * | 10/2000 | Chelaru | D8/335 |
| D445,666 | S | * | 7/2001 | Gable | D8/335 |
| 6,357,266 | B1 | * | 3/2002 | Van Buren | 70/56 |
| 6,405,570 | B1 | * | 6/2002 | Middleton et al. | 70/174 |
| 6,439,008 | B1 | | 8/2002 | Keil | |
| 6,494,064 | B1 | * | 12/2002 | Pena | 70/56 |
| 6,519,982 | B1 | * | 2/2003 | Brammall et al. | 70/56 |
| 6,684,668 | B1 | * | 2/2004 | Hsueh Lee | 70/56 |
| 6,705,137 | B1 | * | 3/2004 | Saladin et al. | 70/212 |

* cited by examiner

*Primary Examiner*—Suzanne Dino Barrett
(74) *Attorney, Agent, or Firm*—Cook, Alex, McFarron, Manzo, Cummings & Mehler, Ltd.

(57) ABSTRACT

A lock protector for protecting a padlock of the type having an exposed shackle and body. The lock protector includes a face plate or shield having a member extending from a rear surface that has two openings for securing the shield to the legs of a shackle. The face plate covers the shackle to protect the shackle from access to cutting devices such as bolt cutters.

11 Claims, 4 Drawing Sheets

LOCK PROTECTOR

BACKGROUND OF THE INVENTION

The present invention relates to devices for protecting padlocks, and more particularly, to a protective cover for preventing access to a padlock shackle and associated hasp staple or locking eye, the protective cover held in place by engagement with the shackle.

Padlocks are widely used to protect the contents of storage sheds, school lockers and other storage areas and containers. The most common padlocks are of the type which include a body and an inverted U-shaped shackle. One leg of the shackle reciprocates from a restrained position to an extended position yet remains fixed to the body while the other leg is seized by the lock mechanism contained in the body. When unlocked, the other leg is able to pivot around the fixed leg and reciprocate along with the fixed leg. In most cases, the shackle of the padlock engages a staple which projects through a slot in the hasp.

While padlocks do provide some measure of security, they are nonetheless vulnerable to attack by thieves using bolt cutters, hack saws, and the like. Lock manufactures have responded by strengthening the shackle. While this approach has had limited success, bolt cutters and other cutting devices have kept pace and continue to present vulnerabilities. In addition, strengthening the shackle of the lock does nothing to protect the staple which may not be manufactured as strong and resilient as the shackle. There is a need therefore for a protective device which shields the shackle and staple from attack by bolt cutters and other such tools. Additionally, the protective device preferably can accommodate various type and sizes of padlocks.

Some lock protectors are known. See, for example, U.S. Pat. Nos. D375,448, D378,568, 4,744,229, 4,799,369, 4,843,845, 5,303,568 and 6,439,008. None of these, however, achieves the results of the present invention.

SUMMARY OF THE INVENTION

Lock protectors as described herein are used to prevent the use of bolt cutters or the like on shackles of padlocks. This is achieved by providing a front shield or face plate with rearward extending arms that have apertures through which the shackle passes. Preferably, the arms are spaced apart both vertically and horizontally, thus limiting the amount of play.

DETAILED DESCRIPTION OF PREFERRED EMBODIMENTS OF THE INVENTION

Figure 2:
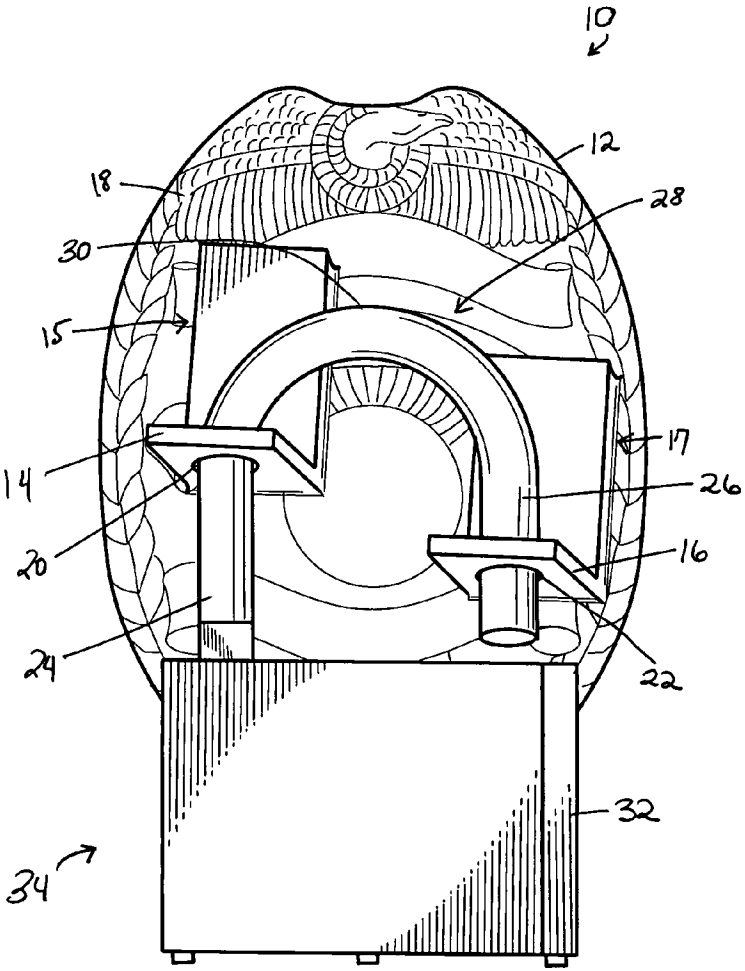
FIG. 2 is a rear perspective view of the lock protector of FIG. 1 engaged with the legs of a shackle.
Figure 1:
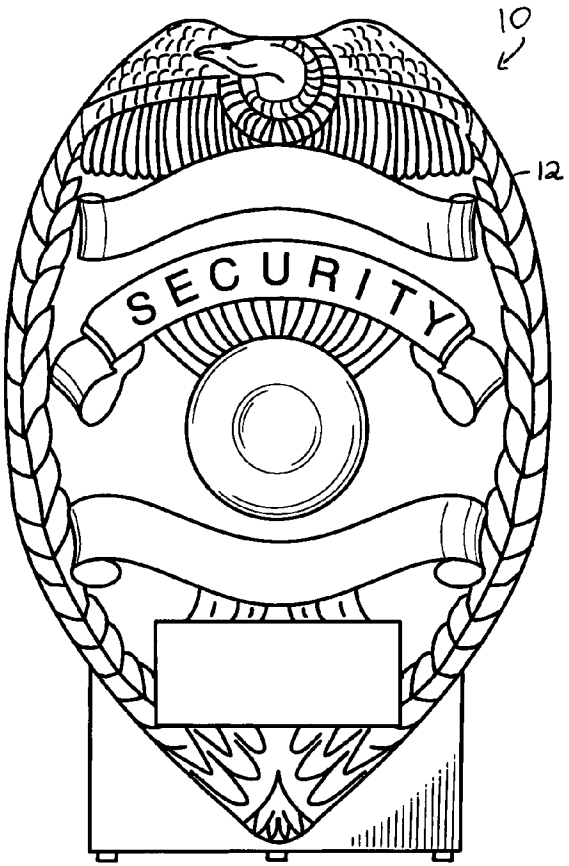
FIG. 1 is a front elevation view of a first embodiment of a protector according to various aspects of the present invention connected to a padlock.

One preferred embodiment of the lock protector of the present invention is shown in FIGS. 1 and 2. The lock protector 10 has a shield or face plate 12 that is shaped to resemble a security or law enforcement badge. The term shield as used herein is not meant to be limited to law enforcement, security or other types of badges but is to be given its broadest definition of a device or part that serves as a protective cover or barrier. The shield or face plate 12 can take many shapes and designs as long as it has sufficient height and width to amply cover the shackle of a reasonable number of lock sizes. Usually, the greater the dimensional extent of the face plate, the greater the degree of protection afforded to the shackle. However, this must be balanced against the need for the lock protector to be compact and easily portable.

In addition, the front or exposed surface of the face plate can also include distinctive marks and/or patterns. The face plate 12 can be made of many resilient materials, preferably a strong metal alloy and even more preferably stainless steel to prevent the protector from rusting, especially if the protector will be used outdoors or in other corrosive environments. Arms 14, 16 extend out from the rear surface 18 of the face plate 12. In the embodiment shown in FIGS. 1 and 2, arms 14, 16 are part of right angle brackets 15, 17 that are either welded or otherwise fixed securely to the rear surface 18 of the face plate 12. The brackets 15, 17 can even be integrally formed with the face plate 12. The arms 14, 16 are also preferably made of a strong and resilient material such as a metal alloy. Care must be taken that the arms do not extend too far from the rear surface 18 of face plate 12 so as to provide enough clearance space to permit entry of bolt cutter jaws.

Openings 20, 22 are centrally located in arms 14 and 16 respectively to accept legs 24, 26 of a shackle 28. The shackle also includes a curved portion 30 that connects the two legs 24, 26. The openings 20, 22 are horizontally spaced apart to match the spacing of legs 24, 26. The openings are large enough to freely accept the legs but not too large as to permit excessive lateral movement of the protector relative to the shackle. Preferably, the openings are also vertically spaced to prevent excessive vertical movement of the protector which would expose the lower end of the legs 22, 24 or the curved portion 30 and staple (not shown) to tampering.

When the shackle is locked (not shown) to the body 32 of lock 34, opening 20 is positioned at an upper area of leg 24 adjacent to where leg 24 joins with curved portion 30, and opening 22 is positioned at a lower area of leg 26 adjacent the area where leg 26 enters the body 32 of lock 34. If vertical movement is attempted, arm 14 will abut the curved portion 30 preventing further upward movement of the protector 10 and arm 16 will abut body 32 preventing further downward movement of the protector 10. By vertically spacing apart the openings, the dimensional extent of the face plate may be kept at a minimum while still covering the shackle to prevent tampering access.

For illustrative purposes only, good results have been achieved with the lock protector having a face plate with a width of 2.5 inches and a length of 3.5 inches when used to protect a padlock having a width, length and depth of 1.75, 2.25 and 0.8 inches respectively. The face plate completely overlies or covers the shackle and extends about 0.5 inches beyond both the left and right sides and about 1 inch beyond the top of the shackle. The openings extend about 0.5 inches from the rear face to limit the entry space for bolt cutter jaws from the sides of the protector.

Figure 4:
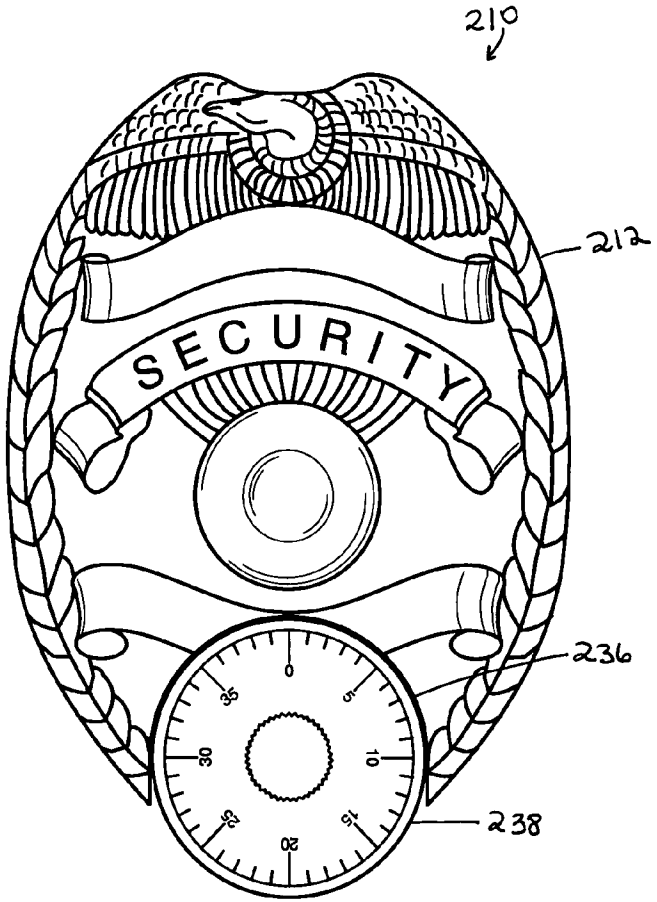
FIG. 4 is a front elevation view of a third embodiment of the protector of the present invention adapted to permit access to the dial of a combination lock.
Figure 3:
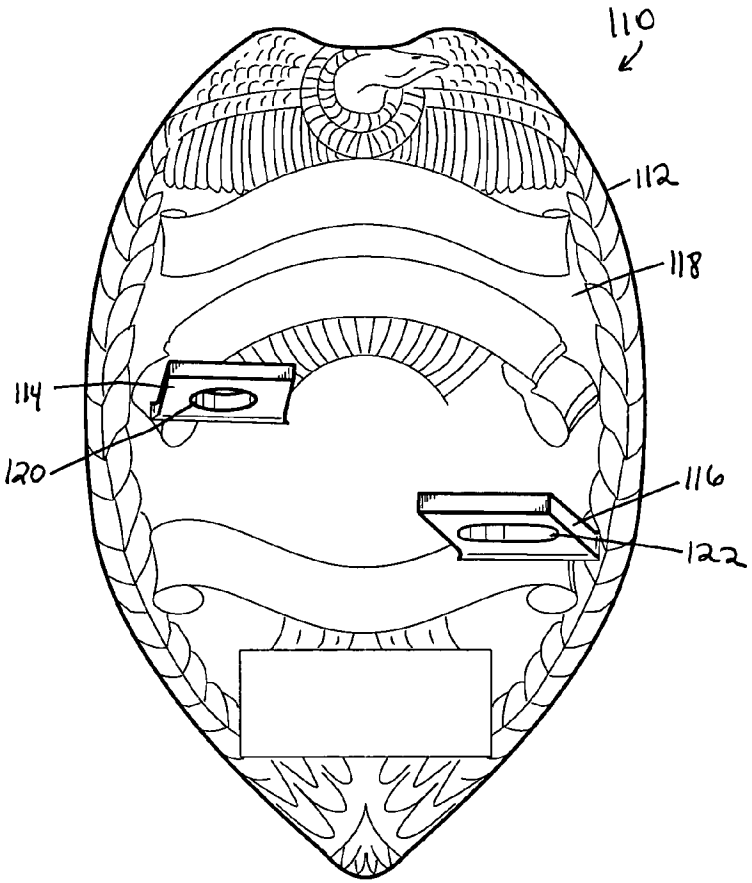
FIG. 3 is a rear perspective view of a second embodiment of the protector of the present invention showing an elongated opening in one of the arms instead of a circular opening.
Figure 5:
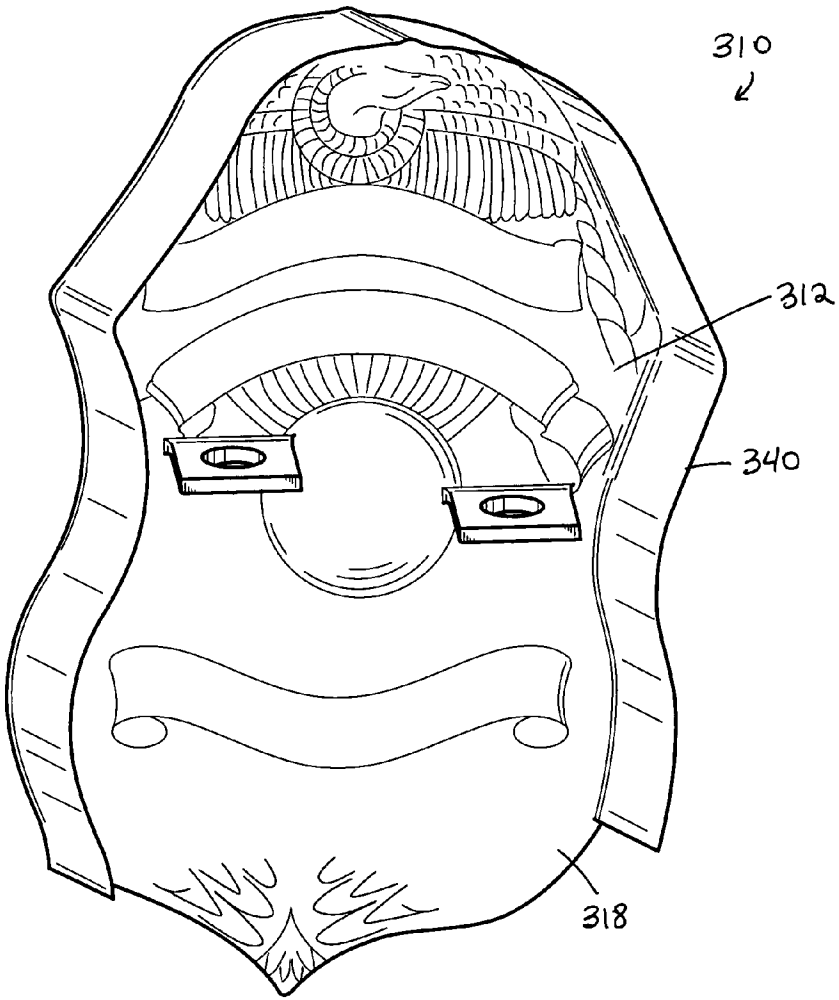
FIG. 5 is a rear perspective view of a fourth embodiment of the protector of the present invention including a shroud to encase the front, top, and sides of a shackle.

FIGS. 3, 4 and 5 show other preferred embodiments of the lock protector of the present invention. In FIG. 3, the lock protector 110 has a face plate 112 and two arms 114, 116 extending out perpendicularly from a rear surface 118. The arms can be securely attached to the rear surface or can be integrally formed with the face plate. An opening 120 is centrally located in the arm 114. Opening 122 in arm 116 is elongated to accommodate some variability in the spacing of the legs of a shackle. Either arm may be lengthened in the width direction to permit an even larger elongated opening.

The lock protector 210 shown in FIG. 4 has a face plate 212. The lower portion of face plate 212 has an access aperture 236 preferably in the form of a semicircular cutout. This cutout matches the outline of and provides access to the dial 238 of a combination lock.

The lock protector 310 shown in FIG. 5 includes a skirt or shroud 340 that encircles the left, top and right outer edge or perimeter of the face plate. By leaving the bottom side of the face plate open, the keyhole of a lock (not shown) is still accessible. The skirt 340 may instead extend from the rear face 318 adjacent the outer edge of the left, top and right sides of the face plate 312.

The lock protector 10, 110, and 210 protects the shackle by preventing tampering access which may come from the front of the padlock. In addition, by limiting the space between the face plate 12, 112, and 212 and the shackle some measure of protection is provided from unauthorized access to the shackle from the left, right and top sides of the padlock when the padlock is used in exposed situations. However, lock protector 310 provides a greater measure of protection in those situations where the padlock is more exposed since the shroud 340 ensures to a greater extent that the shackle cannot be tampered with from the top, left and right sides of the padlock.

Figure 6:
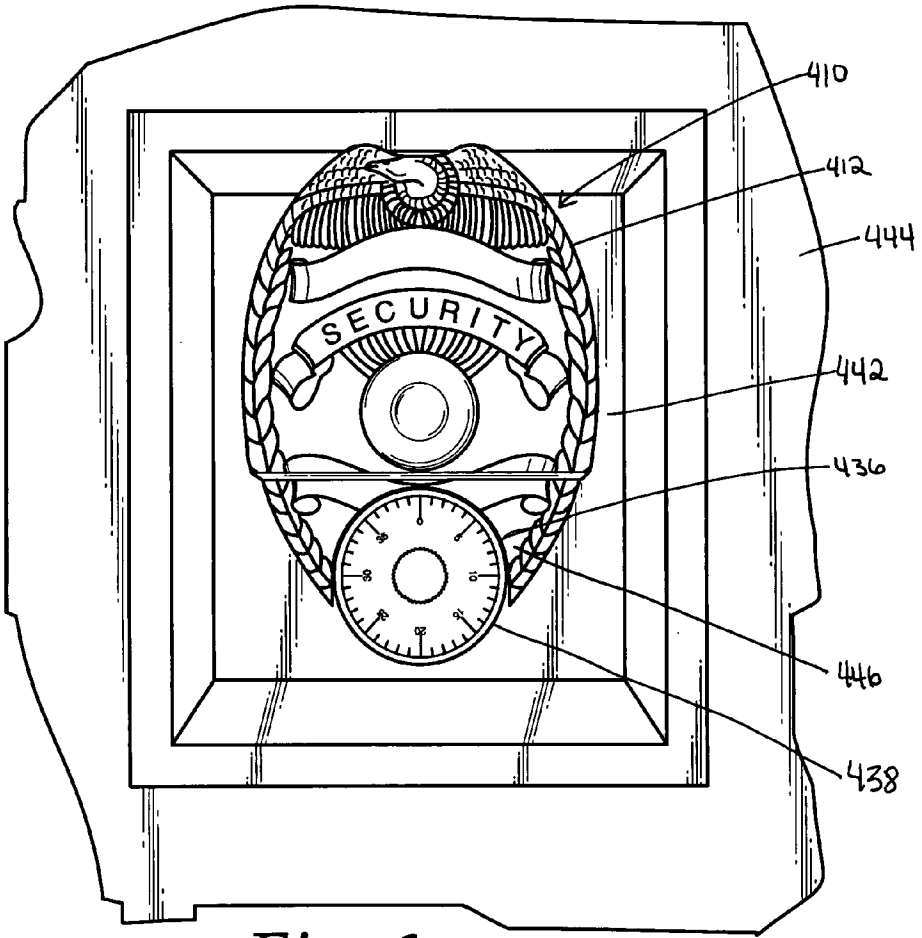
FIG. 6 is a front elevation view of a fifth embodiment of the protector of the present invention protecting a combination lock disposed in a recessed area of a storage locker.

On the other hand there are situations where the padlock is placed in more confined areas. FIG. 6 shows a combination lock placed in the recessed area 442 of a storage locker 444. In these less exposed areas, the added protection afforded by lock protector 340 is not needed. Indeed, it may difficult to attach a shrouded lock protector and padlock onto the locking eye or staple in such confined areas. Lock protectors 10, 110, and 210 are better suited for these situations where the padlock is less exposed. If the recessed area is large enough, the face plate may be able to fit inside when attached to the padlock. In that case, lock protectors 10, 110, and 210 should not require any modification. If however the recessed area is either too small or the placement of the padlock in the recessed area does allow enough space for the face plate, the arms 14, 16, 114, 116 will have to extend rearward to a greater degree so that the openings can still accept the legs of the shackle while the face plate remains flush or extends slightly beyond the locker as shown in FIG. 6.

Figure 7:
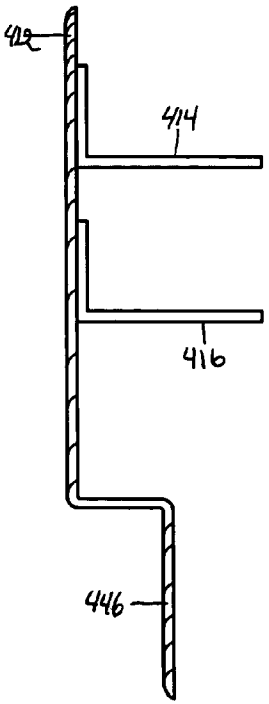
FIG. 7 is a side view of the lock protector of FIG. 6.

Besides this minor modification of extending the arms out farther so that the face plate can be placed outside the recessed area, another embodiment of the lock protector of the present invention is shown in FIGS. 6 and 7 for protecting a combination lock that is placed in the recessed area 442 of a locker. Lock protector 410 has a face plate 412 and arms 414, 416 that extend from the rear of the face plate. As in lock protector 210 face plate 412 has a semicircular cutout to allow access to the dial 438 of a combination lock. However, since the combination lock is disposed in the recess and the face plate including the cutout are either flush or extend slightly beyond the locker, the dial 438 is inaccessible even though a cutout is provided. Lock protector 410 overcomes this problem because the lower portion 446 is offset towards the rear far enough for the cutout 436 to be closer to or flush with dial 438.

As noted above, the face plate 12, 112, 212, or 312 need not have the appearance of a shield but may comprise a simple plate in any variety of shapes, medallion or otherwise. The face plate could be round, oval, oblong, square, rectangular, or any other shape desired. Furthermore, the face plate need not be flat but may even have a curved profile. The size and shape should be large enough to prevent access to the lock shackle by manipulating the face plate.

Instead of two arms each having an opening extending from the rear surface of the face plate of lock protectors 10, 110, 210, 310, and 410, a single arm having two horizontally and vertically spaced openings can be used.

In addition, the protector of the present invention is not confined to use on locks with curved shackles. For example, the shackle could have a generally rectilinear shape and still be used with the protectors described herein.

Installation of the lock protector of the present invention will now be made with reference to the embodiment shown in FIG. 1. First, the padlock 34 is unlocked to free arm 26 from the body 32. Leg 26 is then passed through opening 20, followed by the curved portion 30 until leg 24 is positioned in opening 20. With only leg 24 passed through opening 20, the lock protector 10 can be pivoted about leg 24 to provide room to more easily maneuver leg 26 through the staple of a hasp (not shown). Leg 26 is then passed through a staple or opening in the handle of a school locker (not shown) until the staple rests somewhat off center of the curved portion 30. The face plate 12 can then be rotated to move opening 22 in axial alignment with the hole 42 in the body which captures the free leg 26. Leg 26 is then fed through opening 22. The shackle can then be locked down in the body 32. The lock protector 10 is now securely attached to the shackle 28.

While the present invention has been described in detail with reference to several embodiments, other changes and modification may still be made without departing from the spirit or scope of the present invention. It is understood that the present invention is not to be limited by the embodiments described herein. Indeed, the true measure of the scope of the present invention is defined by the appended claims including the full range of equivalents given to each element of each claim.

What is claimed is:

1. A padlock protector for a padlock having a body and shackle including a connecting member joining laterally spaced apart first and second legs, the padlock protector comprising:

a shield overlying substantially all of said shackle for preventing tampering access thereto; said shield having an upper end portion a lower portion, said lower portion of said shield being offset so that said upper portion extends in a first plane and said lower portion extends in a second plane, said first plane substantially parallel to said second plane;

a first arm extending from a rear face of said shield, said first arm including a first opening to accept said first leg therethrough;

a second arm extending from said rear face, said second arm including a second opening to accept said second leg therethrough, said second opening laterally spaced apart from said first opening so that said first opening aligns with said first leg and said second opening aligns with said second leg, said first and second openings limit movement of said shield in a horizontal plane, and wherein said first and second openings are vertically spaced apart to limit vertical movement of said shield;

whereby threading said first leg through said first opening and said second leg through said second opening and locking said shackle secures said shield to said padlock.

2. The lock protector of claim 1 wherein said lower portion has an aperture for accessing said body.

3. The lock protector of claim 2 wherein said aperture is a semicircular cutout for accessing a dial of a combination lock.

4. The lock protector of claim 1 wherein said lower portion is offset toward the padlock.

5. A lock protector for a padlock including a body and a shackle defined by a first leg, a second leg and an arm joining said first and second leg, said lock protector comprising:

a face plate shielding substantially all of said shackle for preventing tampering access thereto, said face plate having an upper portion and a lower portion, said lower portion of said face plate being offset so that said upper portion extends in a first plane and said lower portion extends in a second plane, said first plane substantially parallel to said second plane; and a member extending from a rear surface of said face plate, said member having a first opening and a second opening, said first and second openings spaced apart in a horizontal direction and a vertical direction, said first opening positioned to engage said first leg and said second opening positioned to engage said second leg of said shackle to retain said face plate to said padlock when said shackle is in a locked state.

6. The lock protector of claim 5 wherein said lower portion has an aperture for accessing said body.

7. The lock protector of claim 6 wherein said aperture is a semicircular cutout for accessing a dial of a combination lock.

8. The lock protector of claim 5 wherein said lower portion is offset toward the padlock.

9. A lock protector for a padlock having a body and a shackle including first and second legs, said lock protector comprising:

a face plate covering substantially all of said shackle for preventing tampering access thereto, said face plate having a rear surface and an upper portion and a lower portion, said lower portion of said face plate being offset so that said upper portion extends in a first plane and said lower portion extends in a second plane, said first plane substantially parallel to said second plane;

a first arm extending from said rear surface, said first arm having a first opening for attaching said first arm to said shackle;

a second arm extending from said rear surface, said second arm having a second opening for attaching said second arm to said shackle, said first and second openings are horizontally spaced apart so that said first opening engages said first leg and said second opening engages said second leg of said shackle for securing said face plate to said padlock, and wherein said first and second openings are vertically spaced apart;

whereby passing said first leg through said first opening and said second leg through said second opening and locking said shackle to said body secures said face plate to said padlock, said vertically spaced apart openings limiting vertical movement of said face plate.

10. The lock protector of claim 9 wherein said lower portion has an aperture for accessing said body.

11. The lock protector of claim 10 wherein said aperture is a semicircular cutout for accessing a dial of a combination lock.

* * * * *